United States Patent [19]

Narushima et al.

[11] 4,016,087

[45] Apr. 5, 1977

[54] SURFACE TREATING AGENT FOR PROCESSING OF METALS

[75] Inventors: Uraji Narushima, Yokohama; Takashi Moriwake, Kawasaki, both of Japan

[73] Assignee: Nippon Paint Co., Ltd., Osaka, Japan

[22] Filed: July 3, 1975

[21] Appl. No.: 593,043

[30] Foreign Application Priority Data

July 8, 1974 Japan ..... 49-78591

[52] U.S. Cl. ..... 252/40.7; 252/40.5; 252/49.3

[51] Int. Cl.[2] ..... C10M 3/22

[58] Field of Search ..... 252/49.3, 40.5, 40.7

[56] References Cited

UNITED STATES PATENTS

| | | | |
|---|---|---|---|
| 3,336,225 | 8/1967 | Sayad et al. | 252/49.3 X |
| 3,423,317 | 1/1969 | Lubowitz et al. | 252/40.7 X |
| 3,563,895 | 2/1971 | Janatka et al. | 252/49.3 X |

FOREIGN PATENTS OR APPLICATIONS

| | | | |
|---|---|---|---|
| 55,636 | 5/1967 | Germany | 252/40.7 |
| 938,511 | 10/1963 | United Kingdom | 252/40.5 |

*Primary Examiner*—Patrick P. Garvin
*Attorney, Agent, or Firm*—Wenderoth, Lind & Ponack

[57] ABSTRACT

A surface treating agent for processing of metals, comprising (A) a water-soluble thermoplastic synthetic resin having a glass transition temperature of 60 to 90° C and an average molecular weight of 15,000 to 50,000 which is obtained by copolymerizing (1) 16 to 40 parts by weight of an ester of acrylic acid with a monovalent aliphatic alcohol having 1 to 8 carbon atoms, (2) 40 to 64 parts by weight of a mixture of styrene and at least one of methyl methacrylate, vinyl acetate and acrylonitrile and (3) 10 to 20 parts by weight of a polymerizable monomer having a carboxyl group as the polar group, (B) a metallic soap and (C) water, said surface treating agent being able to be applied to a metal surface without heating to afford an unsticky coating film having excellent lubricating properties and excellent blocking resistance without accumulation on a press die in deep draw processing of the metal plate.

7 Claims, No Drawings

SURFACE TREATING AGENT FOR PROCESSING OF METALS

The present invention relates to a surface treating agent for processing of metals. More particularly, it relates to a water-dispersible lubricating agent for surface treatment for processing of metals which can assure excellent deep draw processing of metal plates and subsequent surface treatments thereof.

In press processing of metal plates, especially deep draw processing or other highly advanced processing, it has been hitherto usual to apply a press processing oil on the metal surface to be processed just before the processing. Before such application of a press processing oil, a rust preventive oil previously applied to the metal surface must be removed. Thus, the conventional press processing, requires two steps of operation, i.e. the elimination of the rust preventive oil and the application of the press processing oil. In addition, a satisfying deep draw processing has never been attained by such procedure in spite of the application of a press processing oil. To overcome these drawbacks, the application of a dry coating film of wax or synthetic resin onto the previously cleaned metal surface has been proposed, instead of the application of a press processing oil. Although this method is advantageous in that, unlike a press processing oil, the coating film formed is not sticky, the operation is easy and there can be attained relatively good processings of a highly advanced type, especially in deep draw processing, it cannot afford completely satisfying results.

When the treating agents mentioned above are employed, particularly in the form of an aqueous solution or an aqueous dispersion, it is generally important that they be uniform and stable. Otherwise, the metal plate can not be uniformly coated, which exerts a bad influence on the lubricity of the metal surface in deep draw processing. Thus, the treating agents are required to be uniform and stable in an aqueous system, to be readily applied on metal surfaces, preferably without heating and to afford an unsticky coating film. If the coating film is sticky or is not adhered firmly to the metal surface, the coated metal plates adhere to each other or result in the blocking of the coating film when the coated metal plates are piled up or stored in the coil form. Further, in continuous press processing, such coating films are partially peeled off and accumulate on the press die (die-accumulation), which results in marked decrease of the size precision in processing. Therefore, frequent cleaning of the press die is necessary to make the producibility extremely lower. It is also desirable for the coated metal plate to show both an excellent corrosion resistance and a washability for the elimination of the coating film after deep draw processing and so that the conventional chemical treatment with a phosphate solution after the elimination of the coating film is easily effected. In general, the conventional corrosion inhibitors, which can improve the corrosion resistance of metals, adhere firmly to metal surfaces the coating films of such corrosion inhibitors are not easily removed with a conventional mild alkali cleaner. Therefore, it must be washed by a specific method, such as an acid pickling. On the other hand, when a corrosion inhibitor which is readily eliminated by washing is employed, the metal plate is rusted before the press processing or the formed product obtained by the press processing is rusted before the surface treatments for painting or the like. It is usual, for painting after the application of a mild alkali cleaner, to utilize a chemical treatment for the formation of a conversion coating with a phosphate solution or the like. In such cases, when the corrosion inhibitor even slightly remains, the desired formation of a uniform, dense coating can not be attained and the adhesion of the paint and the corrosion resistance of the final product becomes inferior.

An object of the present invention is to provide a surface treating agent for processing of metal plates, which can be applied to a metal surface without heating to afford an unsticky coating film having an excellent lubricating properties and an excellent blocking resistance without accumulation on a press die in deep draw processing of the metal plate and which can be readily washed out with a mild alkali cleaner after the deep draw processing. Further, the subsequent chemical treatment with a phosphate solution or the like and the electrodeposition coating can be effected under conventional conditions.

Another object of the invention is to provide a water-dispersible surface treating agent for processing of metal plates, which can be uniformly and stably kept in an aqueous system and can be applied to a metal surface without heating to afford the desired unsticky coating film.

These and other objects of the invention will be apparent from the description hereinafter.

The surface treatment agent for processing of metals of the present invention comprises (A) a water-soluble thermoplastic synthetic resin having a glass transition temperature of 60° to 90° C and an average molecular weight of 15,000 to 50,000 which is obtained by copolymerizing 16 to 40 parts by weight of an ester of acrylic acid with a monovalent aliphatic alcohol having 1 to 8 carbon atoms, 40 to 60 parts by weight of a mixture of styrene and at least one of methyl methacrylate, vinyl acetate and acrylonitrile and 10 to 20 parts by weight of a polymerizable monomer having a carboxyl group as the polar group, (B) a metallic soap and (C) water.

The water-soluble thermoplastic synthetic resin to be used in the invention has a glass transition temperature of 60° to 90° C, preferably 70° to 80° C, and an average molecular weight of 15,000 to 50,000, preferably 30,000 to 45,000, and is prepared from a monomeric mixture consisting of (1) 16 to 40 parts by weight, preferably 20 to 30 parts by weight, of an ester of acrylic acid with a monovalent aliphatic alcohol having 1 to 8 carbon atoms, (2) 40 to 64 parts by weight, preferably 50 to 60 parts by weight, of a mixture of styrene (St) and at least one of methyl methacrylate (MMA), vinyl acetate (VAc) and acrylonitrile (AN) and (3) 10 to 20 parts by weight of a polymerizable monomer having a carboxyl group as the polar group. As the ester (1), there may be exemplified methyl acrylate (MA), ethyl acrylate (EA), n-propyl acrylate, isopropyl acrylate, n-butyl acrylate (n-BA), isobutyl acrylate, n-octyl acrylate, etc. Examples of the carboxylic monomer (3) are acrylic acid (AA), methaacrylic acid (MAA), maleic acid and itaconic acid. Such carboxylic monomer contributes to the water solubilization of the polymer produced to obtain a water-soluble thermoplastic synthetic resin. It may be employed together with a polymerizable monomer having a hydroxyl group as the polar group (e.g. 2-hydroxyethyl methacrylate, 2-hydroxypropyl methacrylate). The proportion of styrene to the other monomer(s) in the mixture (2) is preferably 1 : 0.8 to 0.8 : 1 by weight with respect to the die-accumulation resistance and the blocking resistance of the final treating agent of the invention. As the other monomer, methyl methaacrylate is favorable for improving these resistances of the treating agent and for attaining satisfactory copolymerization with styrene.

When the amount of the ester (1) in the monomeric mixture is smaller than 16 parts by weight, the plasticity of the polymer produced is lowered. Further, the adhesion of the final treating agent of the invention also deteriorates, which makes it difficult to effect multistep deep draw processing and complicated press processings. When the amount is larger than 40 parts by weight, the final treating agent of the invention affords only a weak and soft coating film, so that sufficient blocking resistance can not be obtained. In case of the amount of the monomeric mixture (2) being smaller than 40 parts by weight, the coating film finally obtained becomes weak and soft or sticky and has insufficient blocking resistance. In case of the amount being larger than 64 parts by weight, the plasticity of the polymer produced is greatly lowered and the adhesion of the coating film obtained from the final treating agent of the invention is also decreased, so that the coating film is readily peeled off from the metal surface even on slight deformation and makes the subsequent processing impossible. Thus, the amounts of the monomeric components (1) and (2) are important factors for the preparation of the treating agent of the invention, because these components give to the treating agent the properties contrary to each other. When the amount of the carboxylic monomer (3) is smaller than 10 parts by weight, the water-solubility of the polymer produced becomes insufficient and makes it difficult to prepare a uniform stable treating agent according to the invention, so that the desired uniform coating film can not be formed on a metal surface. In addition, the elimination of the coating film by washing with a conventional mild alkali degreasing agent (washing for elimination of film) becomes extremely difficult. Even when the amount is larger than 20 parts by weight, on the contrary, the water-solubility is not improved and the use of such a large amount of the substance is disadvantageous from an economical viewpoint.

The water-soluble thermoplastic synthetic resin having the said monomeric composition is required to possess a glass transition temperature of 60° to 90° C and an average molecular weight of 15,000 to 50,000. When the glass transition temperature is lower than 60° C, the treating agent can afford only a weak and soft or sticky coating film, which makes the blocking resistance deteriorate. When the glass transition temperature is higher than 90° C, the adhesion of the coating film formed is lowered and its plasticity is also insufficient, so that the coating film is readily peeled off from the metal surface even on a slight deformation to make the subsequent processings impossible. In case of the average molecular weight being smaller than 15,000, the coating film becomes sticky lowers the die-accumulation resistance. In case of the average molecular weight being larger than 50,000, the water-solubility of the synthetic resin is insufficient and the final treating agent of the invention shows an extremely low workability on application to a metal surface and affords an uneven coating film. In addition, such coating film can be eliminated only with difficulty by washing with a mild alkali degreasing agent after the press processing.

The water-soluble thermoplastic synthetic resin having the said composition and physical properties is commercially available and can be obtained by copolymerizing the ternary monomeric mixture mentioned above in a hydrophilic solvent at 50° to 150° C for 2 to 8 hours in the presence of a polymerization initiator according to a conventional process for solution polymerization. Preparation of an aqueous solution or dispersion of the resin is effected by adjusting the pH value of the system to 6.5 to 8.5 with a basic substance and diluting it with water by a conventional procedure. As usual, the resin concentration is regulated to 15 to 50% by weight. The said hydrophilic solvent may be methanol, ethanol, isopropanol, n-butanol, isobutyl alcohol, butylcellosolve, etc. Among these, isopropyl alcohol is the most preferable with respect to the polymerization temperature and the water-solubility of the resin produced. As the said polymerization initiator, there may be employed any one which can dissolve in the hydrophilic solvent or the monomeric mixture for the resin and release a free radical on heating. Examples of such radical polymerization initiator are benzoyl peroxide, 2,2′-azobisisobutyronitrile, etc. The polymerization initiator is usually used in an amount of 0.1 to 3.0% by weight to the total weight of the system. As the said basic substance, there may be exemplified ammonia, morpholine, an alkylamine such as monoethylamine, diethylamine or triethylamine, an alkanolamine such as monoethanolamine, diethanolamine or triethanolamine, etc.

As the metallic soap to be used in the invention, there may be employed the conventional one such as a salt of a higher fatty acid having 8 to 22 carbon atoms (e.g. caprylic acid, pelargonic acid, capric acid, undecylic acid, lauric acid, tridecylic acid, myristic acid, pentadecylic acid, palmitic acid, heptadecylic acid, stearic acid, monodecanoic acid, arachic acid, behenic acid, oleic acid, etc.) with an alkaline earth metal (e.g. calcium, barium). The metallic soap may be used as such or, if necessary, in the form of an aqueous dispersion, which can be readily obtained by dispersing the metallic soap in water in the presence of a conventional anionic surface active agent (e.g. alkylnaphthalene sulfate, dodecylbenzene sulfate, alkyl sulfate) and/or nonionic surface active agent (e.g. polyethylene glycol oleyl ether, polyethylene glycol nonyl phenyl ether, polyethylene glycol lauryl ether). The use of a dodecylbenzene sulfate as the anionic surface active agent or a polyethylene glycol nonyl phenyl ether as the nonionic surface active agent improves the uniformity of the dispersion. The combined use of these compounds affords a more uniform and stable aqueous dispersion. Usually, the concentration of the dispersion is adjusted to 40 to 60% by weight.

In the present surface treating agent, the water-soluble thermoplastic synthetic resin (A) and the metallic soap (B) are contained in a ratio of 5 : 4 to 5: 1, preferably 3 : 2 to 4 : 1, by weight (A : B). These components (A) and (B) are dispersed in an appropriate amount of water (C). The amount of water (C) is not specifically limited, but it is used in such an amount that the total concentration of the (A) component and the (B) component is 50% by weight or less, preferably in a range of 20 to 40% by weight.

For practical use, the treating agent of the invention comprising the water-soluble thermoplastic synthetic resin, it is desirable to prepare the metallic soap and water by mixing an aqueous solution or dispersion of the resin having a resin concentration of 15 to 50% by weight with an aqueous dispersion of the metallic soap having a concentration of 40 to 60% by weight by a conventional procedure. The mixing proportion of the said aqueous solution or dispersion of the resin to the said aqueous dispersion of the metallic soap is preferably 100 to 450 parts by weight to 10 to 150 parts by weight. When the amount of the aqueous solution or dispersion of the resin is smaller than 100 parts by weight, formation of the desired coating film tends to become difficult. When the amount is larger than 450 parts by weight, the processability in deep draw processing is liable to be lowered. In the case of the amount of the aqueous dispersion of the metallic soap being smaller than 10 parts by weight, the processability in deep draw processing is many times decreased. In cases where the amount of the aqueous dispersion of metallic soap is larger than 150 parts by weight, the die-accumulation resistance and the blocking resistance of the coating film tends to be lowered. When the metallic soap is used as such, heating is necessitated on the film formation, and, in many cases, the obtained film is hygroscopic or sticky. It is thus desirable to use the metallic soap in the form of an aqueous dispersion.

In the treating agent of the invention, a conventional volatile corrosion inhibitor may be utilized, in addition to the said essential components, to impart to the treating agent a corrosion resistance without deteriorating the processability in deep draw processing, the washability for elimination of film or the treatability in the conversion coating formation treatment. In general, a volatile corrosion inhibitor evaporates and disappears at room temperature, and the time that it does remain before evaporation is shortened with elevation of the temperature, so that it is usually used in a closed atmosphere. It has now been confirmed that such volatile corrosion inhibitor, when used as the component of the treating agent of the invention, can maintain its inherent properties even under heating for drying on application of the treating agent to a metal plate or when the treated metal plate is allowed to stand in the air, and the advantageous properties of the treating agent are not deteriorated thereby. As such volatile corrosion inhibitor, there may be employed a conventional one, such as benzoate, isopropylbenzoate, azelate, phenolate, salicylate, ethylhexanolate, butylphosphonate, ethylsulfonate, nitrite, carbonate, borate or carbamate of an organic ammonium compound (e.g. n-amylammonium, isoamylammonium, monoisopropylammonium, diisopropylammonium, di-n-butylammonium, monocyclohexylammonium, dicyclohexylammonium, phenolhydrazineammonium, monoethanolammonium, diethanolammonium, triethanolammonium, ethylmorpholineammonium, naphthylammonium). These compounds may be used solely or in combination or, if necessary, together with fatty acid salts of other amines. Specific examples of the volatile corrosion inhibitor are dicyclohexylammonium nitrite, dicyclohexylammonium carbonate, dicyclohexylammonium benzoate, diisopropylammonium benzoate, diisopropylammonium nitrite, diethanolamine benzoate, etc. The amount of the volatile corrosion inhibitor to be used is preferably 0.5 to 10 parts by weight to the mixture of 100 to 450 parts by weight of the aqueous solution or dispersion of the resin and 10 to 150 parts by weight of the aqueous dispersion of the metallic soap. With an amount smaller than 0.5 parts by weight, a sufficient corrosion resistance can not be exhibited. With an amount larger than 10 parts by weight, the action of the water-soluble thermoplastic synthetic resin tends to be inhibited, which results in a decrease of the washability for elimination of film and the film forming in the chemical treatment. The treating agent of the invention may also contain conventional inorganic and organic additives such as pigments, dyestuffs, defoaming agents, antiseptic agents and perfumes in such amounts that the effect of the treating agent is not inhibited.

The surface treating agent of the present invention is applicable to various metal plates, such as an iron plate, an aluminum plate, a zinc plate, or a plate of an alloy of these metals, preferably a steel plate.

For practical use, the surface treating agent for metal processing having the composition mentioned above is appropriately diluted with water and applied to the metal surface to be processed, previously cleaned, by a conventional procedure so as to obtain a film of 0.5 to 2.5 g/m² in dry state. The application is effected, for example, by roll coating, brushing, immersion, spraying or flow coating. In any procedure, heating of the treating agent is unnecessary. For drying of the coating film, it is not necessary to heat at a high temperature for a long duration of time, but only drying in the air or mild heating (e.g. at 120° C for 2 minutes) is performed. This is advantageous in that it prevents hardening of the metal by heat with lapse of time.

The thus-coated metal plate has a dry, unsticky surface and can be handled with ease. It can well be deep draw processed without die-accumulation of the coating film and stored in a good state, not accompanied with blocking and rust. Further, the washing for elimination of film, the chemical treatment and the electrodeposition coating after the deep draw processing can be effected satisfactorily.

The present invention will be illustrated in more detail by the following Examples and Reference Examples. Among the Examples, there are also included examples for comparison (i.e. Examples 1, 9 and 10).

EXAMPLES 1 to 17

An aqueous solution of a water-soluble thermoplastic synthetic resin having a monomer composition and physical properties as shown in Table 1 (resin concentration, 25% by weight; neutralized with aqueous ammonia), an aqueous dispersion of a metallic soap comprising calcium stearate, polyethylene glycol nonyl phenyl ether and water (metallic soap concentration, 50% by weight), a volatile corrosion inhibitor (dicyclohexylammonium nitrite) and water are mixed together at room temperature in a proportion as shown in Table 2 to prepare a surface treatment agent for metal processing.

The thus-obtained treating agents are each applied to a cold-rolled steel plate (spc-1) (70 × 150 × 0.8 mm), previously cleaned with a mild alkali degreasing agent, by the use of a bar coater in such an amount as obtaining a film of 0.5 to 2.5 g/m² in dry state and dried at 120° C for 2 minutes. The thus-coated steel plate is subjected to the following tests for determining various properties, the results of which are shown in Table 3.

1. Cup drawing test

The specimen is tested by the use of a sheet metal tester (Model 142-12; manufactured by Ericksen) under the conditions of punch diameter (flat herd): 33 mm, punch shoulder radius: 4.5 mm, die diameter: 70 mm, die shoulder radius: 3 mm, and hold-down force: 3000 kg.

Estimation

⊙: Representing that the specimen is normally deep draw processed and the deep draw pressure is smaller, i.e. 2.6 ton or less.

○: Representing that the specimen is normally deep draw processed. The deep draw pressure is 2.7 ton or more.

Δ: Representing that the specimen is deep draw processed with formation of a small amount of bucklings on the metal surface. The deep draw pressure is 2.7 ton or more.

×: Representing that a large amount of bucklings are formed on the metal surface or the specimen is broken to make molding impossible. The deep draw pressure is 2.7 ton or more.

2. Test for die-accumulation resistance:

By the use of a tester similar to the one used in the cup drawing test, the specimen is tested continuously 200 times under a hold-down force of 2000 kg without cleaning of die and punch every time.

Estimation

○: Representing that the die and punch are clean, accumulation thereon being not observed at all.

Δ: Representing that there is a tendency to accumulation on the die and punch.

×: Representing that marked accumulation on the die or punch is observed.

3. Test for blocking resistance:

Two specimens (25 $cm^2$) are piled each other, the coated surfaces being contacted, and the test is carried out at a temperature of 50° to 55° C under a pressure of 7.5 ton/25 $cm^2$ (300 $kg/cm^2$) for 8 hours.

Estimation

○: Representing that no blocking is caused on both surfaces.

Δ: Representing that slight blockings are observed on each of the surfaces.

×: Representing that large blockings are observed on each of the surfaces.

4. Test for corrosion resistance:

The specimen is placed into a sealed vessel, which is kept at a temperature of 25 ± 1° C under a humidity of 95% or more for 30 days.

Estimation

○: Representing that no rust is formed.

Δ: Representing that formation of rust in 5% or less is observed.

×: Representing that formation of rust in 6% or more is observed.

5. Test for washing out of coating film:

A mild alkali degreasing agent ("Ridoline No. 75 TX51" manufactured by Nippon Paint Co., Ltd.) is sprayed on the specimen with a concentration of 2% at a temperature of 65° to 70° C under a spray pressure of 1 $kg/cm^2$ for 2 minutes, and then the specimen is washed with water for 0.5 minute.

Estimation

○: Water repellency, 0%.

Δ: Water repellency, 10% or less.

×: Water repellency, 11% or more.

6. Test for chemical treatment with a phosphate solution:

Zinc phosphate treating agent ("Granodine No. 16N5" manufactured by Nippon Paint Co., Ltd.) is sprayed on the specimen, previously washed for elimination of film, with a concentration (point, 15; acid ratio, 10; toner, 1.0) at a temperature of 55° C under a spray pressure of 1 $kg/cm^2$ for 2 minutes, and then the specimen is washed with water for 0.5 minute and dried.

Estimation

○: Representing that the formed film is macroscopically uniform and the crystals of zinc phosphate are fine and dense microscopically.

Δ: Representing that the formed film is macroscopically uniform but the crystals of zinc phosphate are coarse microscopically.

×: Representing that the formed film is macroscopically uneven and has many interstices.

7. Test for electrodeposition coating:

A paint for electrodeposition coating ("Power Coat No. 6600" manufactured by Nippon Paint Co., Ltd.) is applied to the specimen, previously subjected to the chemical treatment with a zinc phosphate solution, at a temperature of 30° C at 300 volt for 3 minutes. The specimen is then washed with water for 0.5 minutes, setted for 10 minutes and baked at 165° C for 30 minutes.

Estimation

○: Representing that no repelling is observed after passing of electric current and washing with water and the film obtained after baking is uniform and normal.

Δ: Representing that no repelling is observed after passing of electric current and washing with water but the surface state of the film obtained after baking is somewhat abnormal.

×: Representing that repelling is observed after passing of electric current and washing with water and the surface state of the film obtained after baking is markedly abnormal.

Reference Examples 1 to 3

An aqueous solution of a water-soluble thermoplastic synthetic resin having a monomer composition and physical properties as shown in Table 1 (resin concentration, 25% by weight; neutralized with aqueous ammonia), a volatile corrosion inhibitor (dicyclohexylammonium nitrite) and water are mixed together at room temperature in a proportion shown in Table 2 to prepare a surface treating agent for metal processing.

The thus-obtained treating agent is applied to a steel plate in the same manner as in Examples 1 to 17, and the coated steel plate is subjected to the tests mentioned above, the results of which are shown in Table 3.

Reference Examples 4 to 7

Surface treatment of a steel plate is effected in the same manner as in Examples 1 to 17 but using a conventional treating agent as shown below in such an amount as obtaining a film of 1.0 to 2.0 $g/m^2$. The thus-coated steel plate is subjected to the test mentioned above, the results of which are shown in Table 3.

Conventional treating agent used:

Reference Example 4: A press processing oil ("Nippon Kosaku Oil No. 660" manufactured by Nippon Kosaku Oil Co., Ltd.);

Reference Example 5: A wax type surface treating agent ("Lubecoat" manufactured by Bethlehem Co.);

Reference Example 6: A hot melt type surface treating agent (partial fatty acid ester of pentaerythritol);

Reference Example 7: A synthetic resin type surface treating agent (comprising a mixture of polyvinyl alcohol, sodium stearate and a water soluble corrosion inhibitor ("Sanhibitor No. 3" manufactured by Sanyo Chemical Industries, Ltd.) in a proportion of 5 : 5 : 2 (parts by weight) in water).

Table 1

| Example No. | Water soluble thermoplastic synthetic resin: Monomer compositions (parts by weight)* | | | | | | | | | Physical properties | |
|---|---|---|---|---|---|---|---|---|---|---|---|
| | MA | EA | N-BA | MMA | st | VAc | AN | MAA | AA | Glass transition temperature (° C) | Average molecular weight |
| 1 | 40 | | | 20 | 20 | | | 20 | | 55 | 20000 |
| 2 | 24 | | | 28 | 28 | | | 20 | | 75 | 30000 |
| 3 | 16 | | | 32 | 32 | | | 20 | | 89 | 35000 |
| 4 | 27 | | | 31.5 | 31.5 | | | 10 | | 72 | 33000 |
| 5 | 24 | | | 28 | 28 | | | 20 | | 70 | 20000 |
| 6 | 24 | | | 28 | 28 | | | 20 | | 75 | 35000 |
| 7 | 24 | | | 28 | 28 | | | 20 | | 80 | 45000 |
| 8 | | 24 | | 28 | 28 | | | 20 | | 63 | 30000 |
| 9 | | | 24 | 28 | 28 | | | 20 | | 47 | 33000 |
| 10 | 24 | | | 28 | | 28 | | 20 | | 54 | 32000 |
| 11 | 24 | | | | 28 | | 28 | 20 | | 78 | 34000 |
| 12 | 24 | | | 28 | 28 | | | | 20 | 76 | 36000 |
| 13 | 24 | | | 28 | 28 | | | 20 | | 75 | 35000 |
| 14 | 24 | | | 28 | 28 | | | 20 | | 75 | 35000 |
| 15 | 24 | | | 28 | 28 | | | 20 | | 75 | 35000 |
| 16 | 24 | | | 28 | 28 | | | 20 | | 75 | 35000 |
| 17 | 24 | | | 28 | 28 | | | 20 | | 75 | 35000 |
| Reference Example No. | | | | | | | | | | | |
| 1 | 24 | | | 28 | 28 | | | 20 | | 75 | 35000 |
| 2 | 24 | | | 28 | 28 | | | 20 | | 75 | 35000 |
| 3 | 24 | | | 28 | 28 | | | 20 | | 75 | 35000 |

*the abbreviations represent the following monomers, respectively:
MA : Methyl acrylate
EA : Ethyl acrylate
n-BA : n-Butyl acrylate
MMA : Methyl methacrylate
st : Styrene
VAc : Vinyl acetate
AN : Acrylonitrile
MAA : Methacrylic acid
AA : Acrylic acid Table 2

| Example No. | Surface treating agent for metal processing (parts by weight): Aqueous solution of water soluble thermoplastic synthetic resin | Aqueous dispersion of metallic soap | Volatile corrosion inhibitor | Water |
|---|---|---|---|---|
| 1 | 174 | 103 | 2 | 721 |
| 2 | 174 | 103 | 2 | 721 |
| 3 | 174 | 103 | 2 | 721 |
| 4 | 174 | 103 | 2 | 721 |
| 5 | 174 | 103 | 2 | 721 |
| 6 | 174 | 103 | 2 | 721 |
| 7 | 174 | 103 | 2 | 721 |
| 8 | 174 | 103 | 2 | 721 |
| 9 | 174 | 103 | 2 | 721 |
| 10 | 174 | 103 | 2 | 721 |
| 11 | 174 | 103 | 2 | 721 |
| 12 | 174 | 103 | 2 | 721 |
| 13 | 130 | 121 | 2 | 747 |
| 14 | 217 | 86 | 2 | 695 |
| 15 | 304 | 52 | 2 | 642 |
| 16 | 390 | 17 | 2 | 591 |
| 17 | 304 | 52 | 0 | 644 |
| Reference Example No. | | | | |
| 1 | 435 | 0 | 0.5 | 564.5 |
| 2 | 435 | 0 | 2 | 563 |
| 3 | 435 | 0 | 10 | 555 |

Table 3

| Example No. | Test results: Cup drawing | Die-accumulation resistance | Blocking resistance | Corrosion resistance | Washing of coating film | Phosphate treatment | Electro-deposition |
|---|---|---|---|---|---|---|---|
| 1 | ○ | X | X | ○ | ○ | ○ | ○ |
| 2 | ○ | ○ | ○ | ○ | ○ | ○ | ○ |
| 3 | ○ | ○ | ○ | ○ | ○ | ○ | ○ |
| 4 | ○ | ○ | ○ | ○ | ○ | ○ | ○ |
| 5 | ○ | ○ | Δ | ○ | ○ | ○ | ○ |
| 6 | ○ | ○ | ○ | ○ | ○ | ○ | ○ |

Table 3-continued

| Example No. | Test results | | | | | | |
|---|---|---|---|---|---|---|---|
| | Cup drawing | Die-accumulation resistance | Blocking resistance | Corrosion resistance | Washing of coating film | Phosphate treatment | Electro-deposition |
| 7 | ○ | ○ | ○ | ○ | ○ | ○ | ○ |
| 8 | ○ | ○ | ○ | ○ | ○ | ○ | ○ |
| 9 | ○ | X | X | ○ | ○ | ○ | ○ |
| 10 | ○ | X | X | ○ | ○ | ○ | ○ |
| 11 | ○ | ○ | ○ | ○ | Δ | Δ | ○ |
| 12 | ○ | ○ | ○ | ○ | Δ | Δ | ○ |
| 13 | ○ | Δ | Δ | ○ | ○ | ○ | ○ |
| 14 | ○ | ○ | ○ | ○ | ○ | ○ | ○ |
| 15 | ○ | ○ | ○ | ○ | ○ | ○ | ○ |
| 16 | Δ | ○ | ○ | ○ | ○ | ○ | ○ |
| 17 | ○ | ○ | ○ | X | ○ | ○ | ○ |
| Reference Example No. | | | | | | | |
| 1 | X | ○ | ○ | X | ○ | ○ | ○ |
| 2 | X | ○ | ○ | ○ | ○ | ○ | ○ |
| 3 | X | ○ | ○ | ○ | ○ | ○ | ○ |
| 4 | X | ○ | X | Δ | Δ | Δ | Δ |
| 5 | ○ | ○ | X | Δ | X | X | Δ |
| 6 | ○ | ○ | X | ○ | X | X | X |
| 7 | ○ | X | X | ○ | X | X | X |

As is apparent from the above results, the die-accumulation resistance and the blocking resistance are inferior when the glass transition temperature of the water-soluble thermoplastic synthetic resin is lower than 60° C as in the case of Examples 1, 9 or 10. When the amount of the metallic soap becomes smaller as in the case of Example 16, the processability in deep draw processing decreases proportionally. When the metallic soap is not added, as in the case of Reference Examples 1 to 3, a sufficient processability in deep draw processing can not be obtained. The use of the volatile corrosion inhibitor is advantageous with respect to the corrosion-preventing effect, as is obvious from a comparison of Examples 15 and 17.

What is claimed is:

1. A surface treating agent for processing of metals, which comprises (A) a water-soluble thermoplastic synthetic resin having a glass transition temperature of 60° to 90° C and an average molecular weight of 15,000 to 50,000 which is obtained by copolymerizing (1) 16 to 40 parts by weight of an ester of acrylic acid with a monovalent aliphatic alcohol having 1 to 8 carbon atoms, (2) 40 to 64 parts by weight of a mixture of styrene and at least one member selected from the group consisting of methyl methacrylate, vinyl acetate and acrylonitrile wherein the mixture of styrene and the other monomer is in a proportion of 1:0.8 to 0.8:1 by weight, and (3) 10 to 20 parts by weight of a polymerizable hydrocarbyl carboxylic acid, (B) a metallic soap which is a salt of a higher fatty acid having 8 to 22 carbon atoms with an alkaline earth metal, and (C) water, said water-soluble thermoplastic synthetic resin (A) and the metallic soap (B) being contained in a ratio of 5:4 to 5:1 by weight and wherein the total concentration of component (A) and component (B) in water (C) is 50% by weight or less.

2. The surface treating agent according to claim 1, wherein the ester of acrylic acid (1) is a member selected from the group consisting of methyl acrylate, ethyl acrylate, n-propyl acrylate, isopropyl acrylate, n-butyl acrylate, isobutyl acrylate and n-octyl acrylate.

3. The surface treating agent according to claim 1, wherein the polymerizable hydrocarbyl carboxylic acid (3) is a member selected from the group consisting of acrylic acid, methacrylic acid, maleic acid and itaconic acid.

4. The surface treating agent according to claim 1, wherein the mixture of styrene and other monomer (2) is a mixture of styrene and methyl methacrylate.

5. The surface treating agent according to claim 1, wherein the water-soluble thermoplastic synthetic resin (A) and the metallic soap (B) are contained in a ratio of 3:2 to 4:1 by weight.

6. The surface treating agent according to claim 1, which is characterized in that the treating agent is prepared by mixing an aqueous solution or dispersion of the water-soluble thermoplastic resin (A) having a resin concentration of 15 to 50% by weight with an aqueous dispersion of the metallic soap (B) having a concentration of 40 to 60% by weight, the said aqueous solution or dispersion of the resin being mixed in the range of 100 to 450 parts by weight to 10 to 150 parts by weight of the said aqueous dispersion of the metallic soap.

7. The surface treating agent according to claim 1, wherein a volatile corrosion inhibitor is additionally contained in an amount of 0.5 to 10 parts by weight.

* * * * *